US011602786B2

(12) United States Patent
Hartmann

(10) Patent No.: US 11,602,786 B2
(45) Date of Patent: Mar. 14, 2023

(54) APPARATUS FOR CASTING

(71) Applicant: Kurtz GmbH, Kreuzwertheim (DE)

(72) Inventor: Lothar Hartmann, Leinach (DE)

(73) Assignee: Kurtz GmbH, Kreuzwertheim (DE)

( * ) Notice: Subject to any disclaimer, the term of this patent is extended or adjusted under 35 U.S.C. 154(b) by 1169 days.

(21) Appl. No.: 16/065,611

(22) PCT Filed: Jan. 12, 2017

(86) PCT No.: PCT/EP2017/050592
§ 371 (c)(1),
(2) Date: Jun. 22, 2018

(87) PCT Pub. No.: WO2017/121816
PCT Pub. Date: Jul. 20, 2017

(65) Prior Publication Data

US 2021/0268578 A1 Sep. 2, 2021

(30) Foreign Application Priority Data

Jan. 13, 2016 (DE) ..... 20 2016 100 133.1
Jun. 21, 2016 (DE) ..... 10 2016 111 315.8

(51) Int. Cl.
*B22D 23/00* (2006.01)
*B22D 18/04* (2006.01)
*B22D 39/02* (2006.01)

(52) U.S. Cl.
CPC ..... *B22D 23/006* (2013.01); *B22D 18/04* (2013.01); *B22D 39/026* (2013.01)

(58) Field of Classification Search
CPC ..... B22D 23/006; B22D 18/04; B22D 39/026
See application file for complete search history.

(56) References Cited

U.S. PATENT DOCUMENTS 5,163,500 A * 11/1992 Seaton ..... B22D 18/04 164/119
5,601,135 A 2/1997 Merrill
6,059,011 A 5/2000 Giolo
(Continued)

FOREIGN PATENT DOCUMENTS

CN 1964805 A 5/2007
CN 201644758 U 11/2010
(Continued)

OTHER PUBLICATIONS

English machine translation of JP-2010214423A (Year: 2010).*
(Continued)

*Primary Examiner* — Kevin P Kerns
*Assistant Examiner* — Steven S Ha
(74) *Attorney, Agent, or Firm* — HoustonHogle LLP

(57) ABSTRACT

The invention relates to an apparatus for the casting of cast parts according to the permanent mold casting method comprising:

Figure 1:
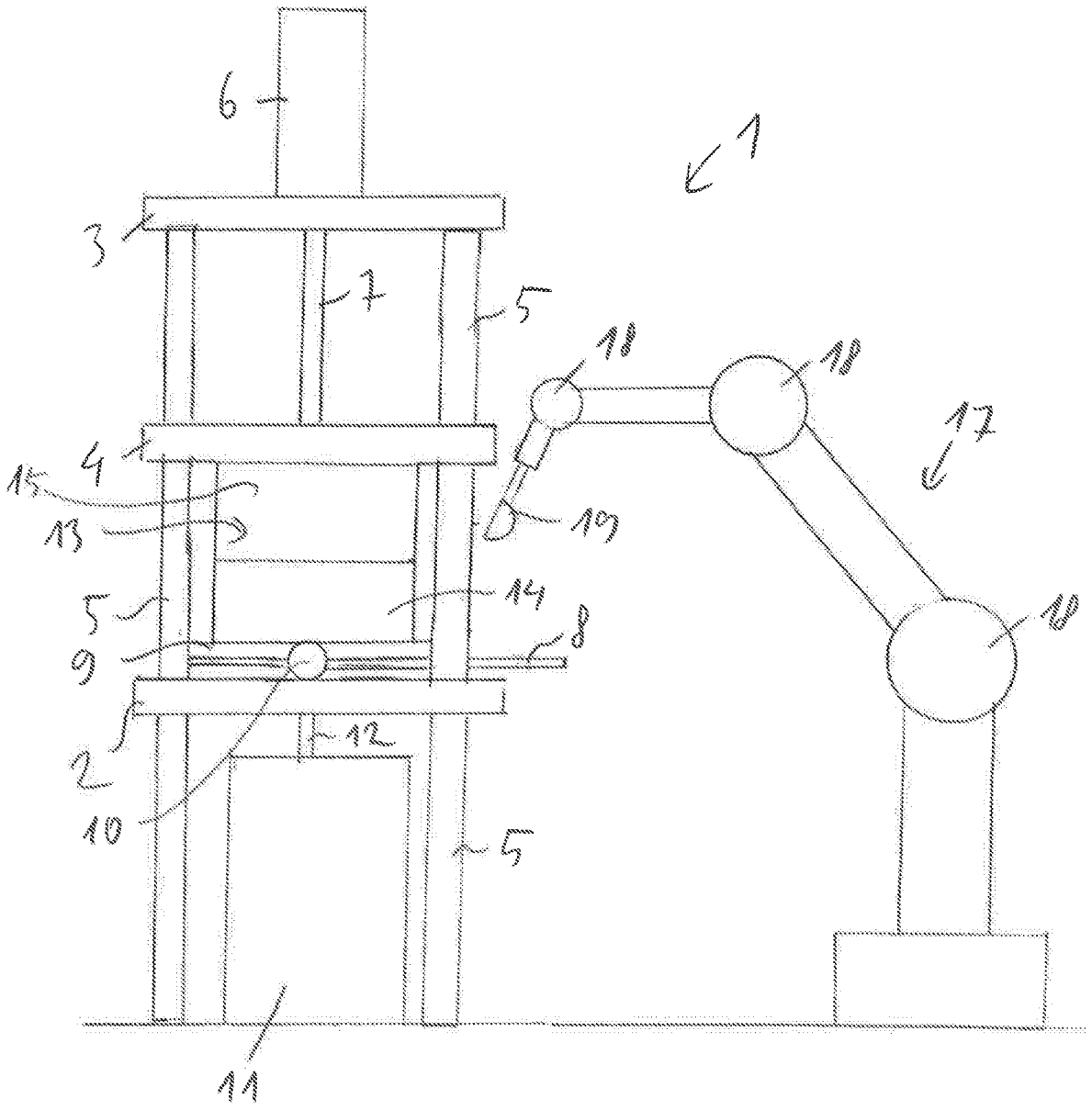

- a pivotable retaining element (9) for holding a permanent mold (13, 16)
- a furnace (11) which may be connected to a low-pressure permanent mold (13) in such a way that melt may be fed to the low-pressure permanent mold (13) in accordance with the low-pressure process, and
- a melt feed device (17) by which melt may be fed to a gravity permanent mold (16), wherein the gravity permanent mold (16) may be mounted on the retaining element (9).

18 Claims, 4 Drawing Sheets

(56) References Cited

U.S. PATENT DOCUMENTS

| | | | | |
|---|---|---|---|---|
| 8,302,659 | B2 | 11/2012 | Smetan et al. | |
| 8,783,331 | B2 | 7/2014 | Heinecke et al. | |
| 9,415,441 | B2 | 8/2016 | Heinecke et al. | |
| 9,545,666 | B2 | 1/2017 | Calin et al. | |
| 2001/0050156 | A1* | 12/2001 | Meyer | B22D 33/02 164/136 |
| 2002/0195224 | A1* | 12/2002 | Shiose | B22D 18/06 164/119 |

FOREIGN PATENT DOCUMENTS

| | | | |
|---|---|---|---|
| CN | 203817343 | U | 9/2014 |
| CN | 105215338 | A | 1/2016 |
| DE | 3006785 | C2 | 10/1980 |
| DE | 4434258 | A1 | 11/1995 |
| DE | 69701367 | T2 | 9/2000 |
| DE | 102010026480 | A1 | 3/2011 |
| DE | 10210022343 | A1 | 12/2011 |
| DE | 102014102724 | A1 | 6/2015 |
| DE | 102015119243 | A1 | 5/2017 |
| EP | 0976476 | A1 | 2/2000 |
| EP | 1481749 | A1 | 1/2004 |
| GB | 2046149 | A | 11/1980 |
| JP | 2010214423 | A | 9/2010 |
| KR | 101121148 | B1 | 6/2011 |
| WO | WO2010058003 | A1 | 5/2010 |
| WO | WO2011003396 | A1 | 1/2011 |
| WO | WO2016201479 | A1 | 12/2016 |
| WO | WO2017081026 | A1 | 5/2017 |

OTHER PUBLICATIONS

Search Report, dated Mar. 6, 2017, from German Application No. 10 2016 111 315.8, filed on June 21, 2016. Ten pages.

Search Report, dated Oct. 17, 2016, from German Application No. 20 2016 100 133.1, filed on January 13, 2016. Four pages.

International Search Report of the International Searching Authority, dated Apr. 10, 2017, from International Application No. PCT/EP2017/050592, filed on Jan. 12, 2017. Six pages.

International Preliminary Report on Patentability, dated Jul. 26, 2018, from International Application No. PCT/EP2017/050592, filed on Jan. 12, 2017. Twenty pages.

* cited by examiner

APPARATUS FOR CASTING

RELATED APPLICATIONS

This application is a § 371 National Phase Application of International Application No. PCT/EP2017/050592, filed on Jan. 12, 2017, which claims priority to German Application No. 20 2016 100 133.1, filed on Jan. 13, 2016, and German Application No. 10 2016 111 315.8, filed on Jun. 21, 2016, both of which are incorporated herein by reference in their entirety.

The present invention relates to an apparatus for the casting of metal bodies, in particular using a permanent mold casting method.

Permanent mold casting machines are adequately known. A permanent mold bounds a mold cavity. Liquid metal is fed into the mold cavity, where it cures. On demolding, the cured metal piece is removed from the permanent mold.

In low-pressure casting, a permanent mold with two mold halves is often used, and is mounted in a vertical press. The press is used to press together the two mold halves of the permanent mold. The liquid molten metal is fed into the permanent mold from below, under low pressure.

For easy demolding, a press with a sliding table may be used. The sliding table has a horizontally movable frame, on which one mold half of the permanent mold is mounted. For demolding, the other mold half is raised and the frame is moved away from the area of the press, so that the cast part may be easily removed.

Known from WO 2010/05 8 003 A1 is a permanent mold casting method in which the liquid melt is distributed in the mold cavity by rotating the permanent mold. This casting method is also known as gravity casting.

Disclosed in DE 30 06 785 C2 is a low-pressure permanent mold casting machine. This machine comprises a smelting furnace and a layer charging container, with a support column rotatable around its vertical axis arranged between them. Fastened to the support column is a support frame which has a guide in which a bearing head may be moved vertically. Mounted in the bearing head is a T-shaped support frame, pivotable around a radial axis horizontal to the support column. Mounted on a cross-beam of the support frame are two holders. The holders are on the one hand movable on a longitudinal axis of the cross beam and on the other hand pivotable around this longitudinal axis. Mounted in each of the two holders, which are parallel to one another, is a support arm, to each of which one half of a permanent mold is attached. The support arms are therefore rotatable around their own longitudinal axis and in addition pivotable around axes which are vertical to their rotation axis and to the longitudinal axis of the holder. In this way it should be possible to traverse the permanent mold halves into any desired position and, moreover, to cast in a parting plane. It should also be possible to remove a cast part, since the permanent molds may be rotated in such a way that a casting pin is directed forwards, so that simple gripping by conventional tongs is possible. Due to the fact that by means of the apparatus, the permanent mold and also a riser pipe can be held, it is possible that even when a parting line runs vertically, the sprue pin need not be pulled off.

DE 44 34 258 A1 discloses a quick-change frame for permanent mold casting machines. Such a quick-change frame includes guide rails, designed for tilting through 90° relative to the horizontal. The quick-change frame is also removable from the permanent mold casting machine so that after casting, another quick-change frame in which is clamped a permanent mold already heated to operating temperature, may be inserted in the still lowered guide rails. Through use of the quick-change frame it should be possible to reduce the space requirements of a permanent mold casting machine, since it is no longer necessary for a whole casting device to be tilted upwards. More rapid processing should also be possible through the use of several quick-change frames with suitably preheated permanent molds.

Disclosed in DE 697 01 367 Part 2 are a low-pressure permanent mold casting machine and a corresponding method for operation of the machine. This low-pressure permanent mold casting machine comprises a first furnace and a second furnace, also two handling units which are assigned to the furnaces alternately. Provided between the furnaces is a station for unloading of the cast parts and for carrying out graphitization of the casting mold. By means of this station it should be possible to use the furnaces with operating pressures and metal filling levels independently of one another. The handling units are provided with an extraction unit to remove the cast part, with the extraction unit being provided to move the cast part towards an operator and to rotate the cast part around a horizontal axis. In this way, through the alternate assignment of handling units to the furnaces, it should be possible to provide a casting installation with optimized downtime. This should facilitate improved handling and accessibility of a permanent mold, in order to raise production capacity.

The invention is based on the problem of creating an apparatus for casting by the permanent mold casting method, with which different casting methods may be implemented.

The problem is solved by an apparatus with the features of claim 1. Advantageous developments are set out in the dependent claims.

An apparatus according to the invention for the casting of cast parts according to the permanent mold casting method comprises

- at least one pivotable retaining element, preferably movable horizontally, for holding a permanent mold
- a smelting furnace which may be connected by means of a melt line to a low-pressure permanent mold in such a way that melt may be fed to the low-pressure permanent mold in accordance with the low-pressure process, and
- a melt feed device by which melt may be fed to a gravity permanent mold mounted on the retaining element.

By means of the apparatus according to the invention, a permanent mold mounted in the retaining element may be moved from one location, preferably in a horizontal direction, to another location. In contrast to this it is provided, for example in the apparatus described in DE 30 06 785 C2, that a permanent mold is rotated, turned, lifted and thus moved in all directions.

The pivoting is provided according to the invention to execute a controlled casting process, in contrast to the apparatus disclosed in DE 44 34 258 A1, in which it should be possible, by swiveling the quick-change frame, to pull the quick-change frame from the guide rails by means of a crane hook.

The apparatus according to the invention for the casting of cast parts includes, to carry out the permanent mold casting method, at least one pivotable retaining element, preferably capable of horizontal movement, for holding a permanent mold, a smelting furnace which may be connected by means of a melt line to a low-pressure permanent mold in such a way that melt may be fed to the low-pressure permanent mold in accordance with the low-pressure process, and a melt feed device by which melt may be fed to a gravity permanent mold mounted on the retaining element.

Consequently, according to the invention, a combined apparatus is provided with which, on the one hand, melt from the smelting furnace may be fed by the melt line directly to a low-pressure permanent mold, and on the other hand, by means for example of a bale-out device, melt is taken from the smelting furnace and may be fed to a gravity permanent mold.

With the apparatus according to the invention it is therefore possible with a single apparatus to carry out not only low-pressure but also gravity and tilting casting.

The permanent mold casting method is a method of casting in which a melt is poured via an upwards lying sprue into a coquille called a metal permanent mold, the hollow space of which is filled entirely due to gravity. Within the scope of the present invention, such permanent mold casting methods are understood to include for example drop casting, gravity casting, tilting crucible casting (by level shifting) and low-pressure casting.

Preferably the casting apparatus has a control unit, which is designed to swivel the retaining element for even distribution of the melt in the gravity permanent mold.

The horizontally movable and pivotable retaining element may be a holding frame, such as is known from conventional slide-tilt tables.

Due to the provision of the melt feed device with which melt may be fed to a gravity permanent mold, located on the retaining element, it is possible to distribute the melt evenly in a gravity permanent mold by pivoting the retaining element and therefore rotating the gravity permanent mold.

The retaining element is preferably so designed that it may be swiveled or rotated from a horizontal position into an inclined position around an angle of at least 45°, preferably at least 90°, in particular at least 180° and preferably 360°.

The retaining element preferably has holding devices such as e.g. clips or bolts by which the gravity permanent mold may be fixed to the retaining element, so that it is connected firmly to the retaining element even in an inclined position.

For swiveling the permanent mold, a pivotably mounted tilting plate may be provided. The retaining element is preferably a holding frame which is movable on the tilting plate.

The furnace is preferably a combined low-pressure bale-out furnace, so that on the one hand melt from the smelting furnace may be fed via a melt line, preferably by means of a low-pressure controller, directly to a low-pressure permanent mold or a gravity permanent mold, and on the other hand by means of a bale-out device, melt may be taken from the smelting furnace and fed to the gravity permanent mold. A customary robot may be provided as bale-out device.

Instead of a bale-out device, a bale-out line or metering line may also be provided, by which melt may be fed from the furnace to the gravity permanent mold under the application of low-pressure.

Preferably a lifting device is provided for raising the furnace. Using this lifting device, the furnace may be positioned with its top directly underneath a base plate which carries the permanent mold. By this means, the height difference between the permanent mold and the smelting furnace may be reduced.

Instead of a combined low-pressure bale-out furnace it is also possible to provide two furnaces, with one serving to supply the low-pressure permanent mold with melt and the other being used to supply the gravity permanent mold with melt.

To hold the melt, the gravity permanent mold has a pouring basin which is a section of the permanent mold open at the top, wherein by rotating the permanent mold through a predetermined rotation axis, the melt flows from the pouring basin into the mold cavity.

Preferably the casting apparatus has a press, in particular a column press.

Such a column press may be formed by a fixed base plate, a fixed top frame and a movable clamping plate, with columns being arranged at each of the corner areas of the plates and at the corner areas of the top frame. The columns are generally stationary. It is however also possible for two front columns to have vertical movement capability, as described in German patent application DE 10 2015 119 243.8. Reference is therefore made to this patent application in full.

The press has, preferably on the top frame, a lifting mechanism which may be used to move the movable clamping plate in the vertical direction.

The press is provided primarily for the pressing together of two mold halves of a low-pressure permanent mold, so that melt may be fed to the low-pressure permanent mold under pressure. The top mold half of the low-pressure permanent mold may be fixed to the movable clamping plate, so that after the casting process, by means of the movable clamping plate, the permanent mold may be opened by lifting the clamping plate and thereby lifting the top mold half of the permanent mold.

The gravity permanent mold may be single- or multi-part. If the gravity permanent mold is multi-part in design, then the individual parts are fastened to one another during the casting process by means of clips, bolts or other suitable fixing devices. For demolding, the several parts of the gravity permanent mold may be separated from one another.

Figure 2:
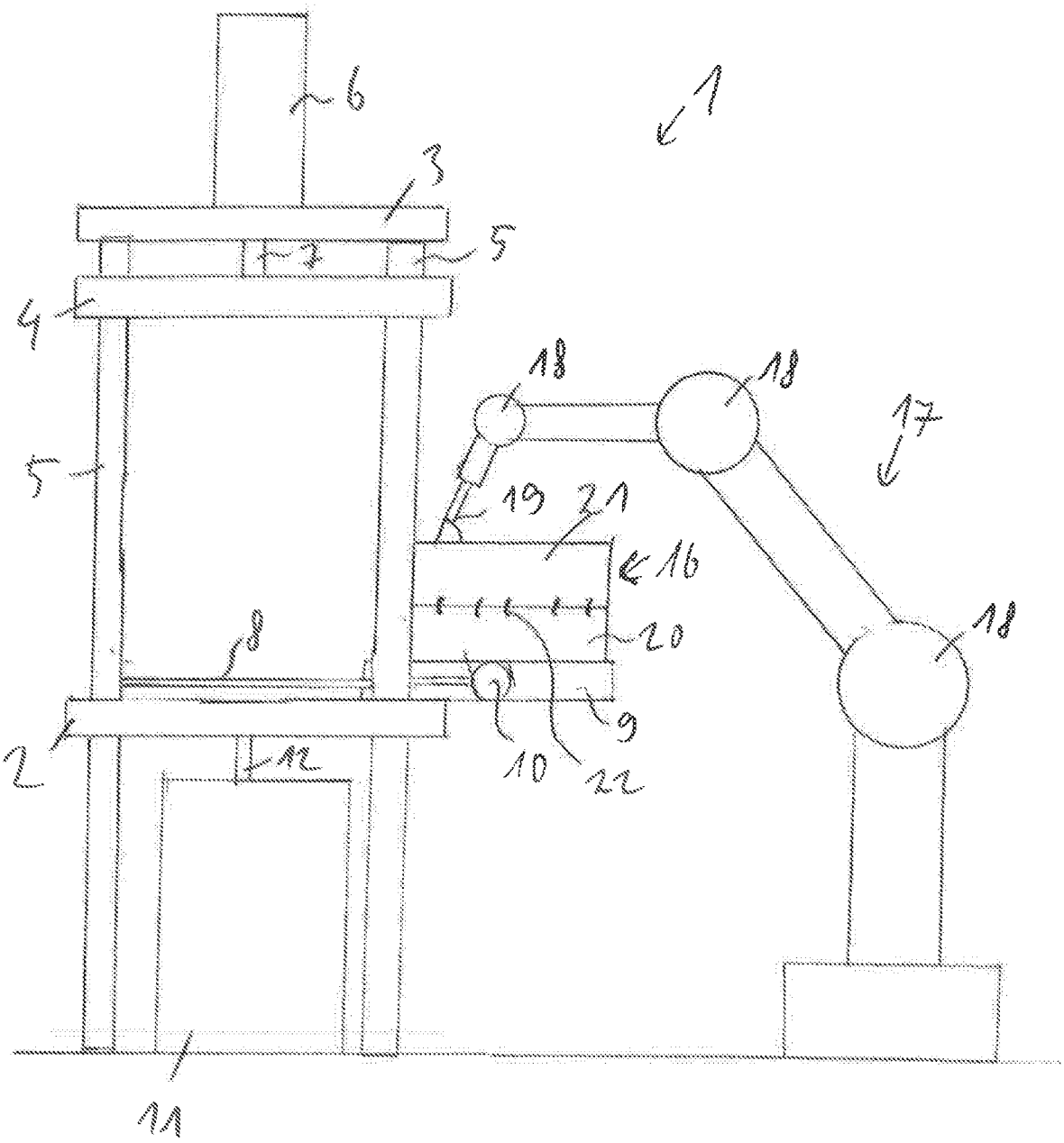
Figure 3:
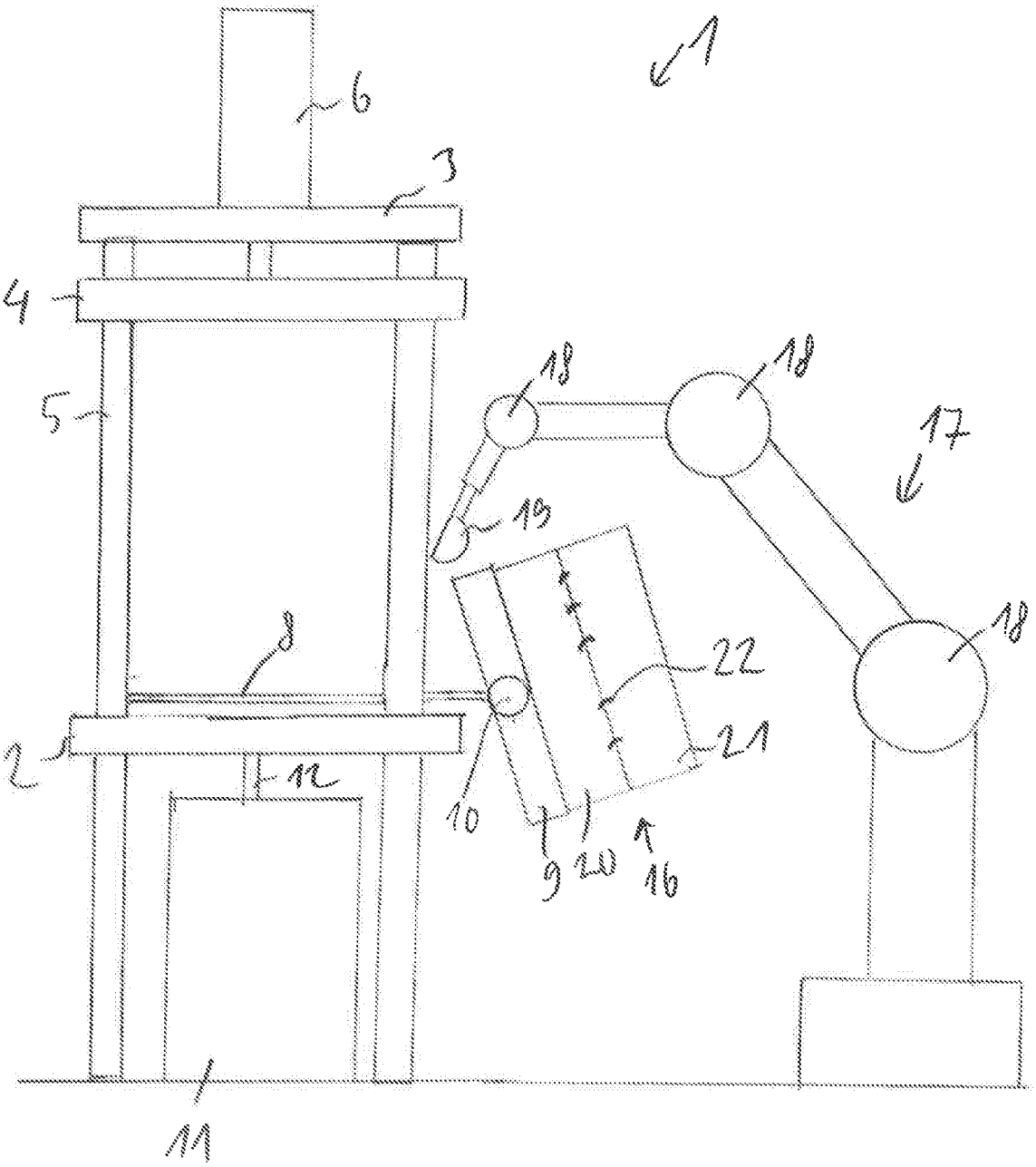
Figure 4:
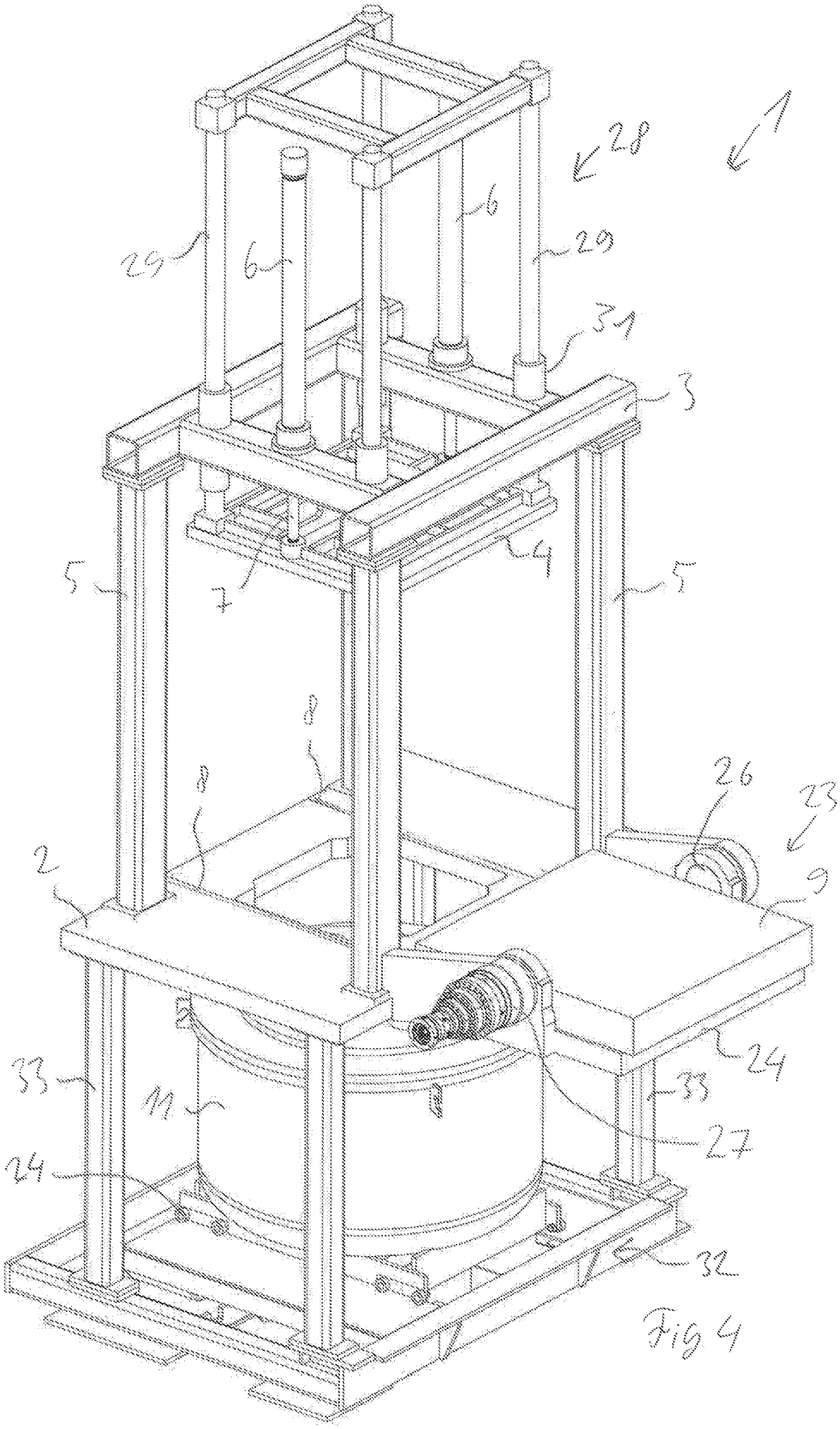

An embodiment of the present invention is described in detail below with the aid of the appended drawings, which show in:

FIG. 1 a schematic view of a casting apparatus according to the invention with a low-pressure permanent mold FIG. 2 the apparatus of FIG. 1 with a gravity permanent mold, wherein the gravity permanent mold is fixed to a horizontally arranged retaining element FIG. 3 the apparatus according to FIG. 1 with the gravity permanent mold, wherein the retaining element and the gravity permanent mold are tilted, and FIG. 4 a further embodiment of a casting apparatus according to the invention.

An embodiment of a casting apparatus 1 has a horizontally arranged base plate 2, a top frame 3, and a movable clamping plate 4 in between. Provided at each of the corner areas of the plates 2, 4 and the top frame 3 are columns 5, extending in principle from the base plate 2 to the top frame 3 and holding them apart. The base plate 2, the top frame 3 and the movable clamping plate 4 are arranged parallel to one another.

The columns 5 extend through suitable through holes in the movable clamping plate 4 and serve to guide the movable clamping plate 4 so that the movable clamping plate 4 is always parallel to the base plate 2 and the top frame 3.

The base plate 2 and the movable clamping plate 4 are designed as plate-like elements. They may however also be in the form of a frame-like rack. In the embodiment, the top frame 3 is in the form of a frame-like rack. It may however also be a plate-shaped element.

A lifting mechanism 6 is located on the top frame 3. In the present embodiment, the lifting mechanism is a hydraulic cylinder. The lifting mechanism 6 is connected by a lifting rod 7 to the movable clamping plate 4 and can adjust this in the vertical direction. It may also be expedient to provide several lifting mechanisms to move the movable clamping plate 4. In the present embodiment, the lifting mechanism 6 is arranged centrally on the top frame 3. If several lifting mechanisms are provided, then they may be arranged at the edge areas of the top frame 3.

Provided on the base plate 2 are rails 8, which extend from a rear edge of the base plate 2 to beyond a front edge of the base plate 2. The rails 8 serve to guide a holding frame 9 which is connected to the rails 8 by means of a coupling element 10. The coupling element 10 serves to move the holding frame 9 in the longitudinal direction of the rails 8 and also for rotating or swiveling the holding frame 9.

The part of the casting apparatus 1 described so far thus forms a column press with a slide-tilt table.

Provided in the area below the base plate 2 is a furnace 11. The furnace 11 has a melt line 12 which is guided upwards through the base plate 2 and is designed for the connection of a low-pressure permanent mold 13. The low-pressure permanent mold 13 is formed of a bottom mold half 14 and a top mold half 15. The bottom mold half 14 is mounted on the holding frame 9. In operation, the top mold half 15 is subjected to pressure from the clamping plate 4, so that the bottom mold half 14 and the top mold half 15 are pressed firmly together. The top mold half 15 is attached to the movable clamping plate 4, preferably releasably. In the situation shown in FIG. 1, according to the low-pressure method, melt may be fed from the furnace 11 to the low-pressure permanent mold 13 via the melt line 12.

Once the melt has hardened into a cast part, the clamping plate 4 and with it also the top mold half 15 are raised. By this means, the low-pressure permanent mold 13 is opened. The bottom mold half 14 of the low-pressure permanent mold is moved by means of the horizontally movable holding frame 9 beyond the front edge of the base plate 2. The holding frame 9 is tilted a little, so that an operator may easily remove the cast part from the bottom mold half 14. The cast part may also be removed by robots. However, removal does not require that the table be tilted.

Instead of a low-pressure permanent mold 13, a gravity permanent mold 16 may also be mounted on the holding frame 9. The gravity permanent mold 16 may have in its upper area a pouring basin (not shown), which is a trough-like or channel-like element, open at the top. The pouring basin may be filled with melt. Provided for filling the gravity permanent mold with melt in the present embodiment is a robot 17, which has several hinges 18. The robot 17 has a free end, to which a ladle 19 is attached.

Using the ladle 19, the robot is able to take melt from the furnace 11 and pour it into the pouring basin of the gravity permanent mold 16. Here the holding frame 9 is arranged optionally horizontally or vertically or at another angle, so that the pouring basin is open at the top. By rotating the holding frame 9 and with it the gravity permanent mold 16, the melt flows into a mold cavity formed in the gravity permanent mold 16 where it is distributed evenly. The gravity permanent mold is preferably fastened to the holding frame 9 with suitable fastening elements, so that the gravity permanent mold 16 is held securely to the holding frame, even during a pivoting process. For better distribution of the melt and for better feeding of the cast part, the permanent mold may be rotated by up to 360°, preferably approximately 180°, by means of the rotatable table.

After the melt has cured, the gravity permanent mold 16 is demolded. For demolding, it may be swiveled into a suitable position. In the present embodiment, the gravity permanent mold 16 is made up of a bottom mold half 20 and a top mold half 21, held together by clamps 22.

For demolding, the clamps 22 are loosened and the two mold halves 20, 21 separated from one another. The cast part may then be removed from the bottom mold half.

The robot 17 may be provided at its free end with a changeover device, so that different tools such as ladies, gripping devices or the like may be attached to the robot 17. With such a gripping device, the cast part may also be removed automatically from the bottom mold half 20 of the gravity permanent mold 16, using the robot.

The robot 17 serves as melt feed device for feeding melt to the gravity permanent mold. It is also possible to provide other melt feed devices, such as e.g. a melt line or low-pressure line, terminating in the area above the pouring basin of the gravity permanent mold.

With the combination of melt feed device and pivotable holding frame 9, which serves as retaining element for the permanent mold, it is possible in one casting apparatus to execute not only a low-pressure casting method with a low-pressure permanent mold but also a gravity casting method with a gravity permanent mold.

The holding frame 9 is not necessarily horizontally traversable. In principle it is also possible to arrange the gravity permanent mold at the same point as the low-pressure permanent mold during the casting process. It is however advantageous if the holding frame or retaining element is horizontally movable, since this simplifies the arrangement of the furnace and the melt line.

FIG. 4 shows a further embodiment of a casting apparatus 1 according to the invention, which again has a base plate 2, a top frame 3, a movable clamping plate 4, and columns 5 extending between the base plate 2 and the top frame 3. Again, below the base plate 2, a furnace 11 is provided, and the clamping plate 4 in this embodiment has two lifting mechanisms 6, each in the form of hydraulic cylinders to operate one lifting rod 7 in each case. A holding frame 9 is arranged to be movable horizontally on rails 8, so that the holding frame may be mounted on the base plate 2 in the area within the columns 5. The present embodiment differs from the embodiment described above in that a tilting table 23 is fixed to the base plate 2 and has a tilting plate 24 independent of the holding frame 9. The tilting table 23 includes two stable holding arms 25, extending forwards from the front edge of the base plate 2 and rising slightly. Provided at each of the free ends of the holding arms 25 is a swivel joint 26 by which the tilting plate 24 is mounted pivotably on the holding arms 25. In addition, there is provided on one of the two holding arms 25 a swivel motor 27, by which the tilting plate 24 may be made to swivel around a horizontal axis.

In its horizontal position, the surface of the tilting plate 24 is flush with the surface of the base plate 2. Provided on the tilting plate 24 and on the base plate 2 are rail sections 8 lying flush with one another so that the holding frame 9, in the horizontal position of the tilting plate 24, may be moved to and fro on the rails 8 between the tilting plate 24 and the base plate 2. The holding frame 9 is moved by means of hydraulic piston/cylinder units (not shown). In this embodiment, the movable clamping plate 4 is not guided on the columns 5, but instead is provided on a separate guide mechanism 28 comprising four guide rods 29, each fixed at one end in the area of a corner of the clamping plate 4 and at the other end to a guide frame 30. Each of the guide rods 29 extends through a through opening in the top frame 3, while sliding sleeves 31 are provided on the top frame 3 to guide the guide rods 29. The guide mechanism 28 may be moved by the two hydraulic lifting mechanisms 6 or be held in its respective vertical position.

In this embodiment, a bottom plate 32 on which the furnace 11 is located is provided below the base plate 2. The base plate 2 is held at a distance from the bottom plate 32 by means of four bottom columns 33. The bottom columns 33 are independent of the columns 5. The furnace 11 is mounted movably on rollers 34, so that the furnace 11 may be moved out of the area between the bottom plate 32 and the base plate 2 and moved back in again. The furnace 11 is arranged on a lifting device (not shown), by which the furnace 11 may be raised a little. The lifting distance is such that the furnace 11 with its top in the raised position is a short distance directly below the base plate 2.

This casting apparatus 1 again has a robot, which is omitted from FIG. 4 to simplify the illustration. FIG. 4 also shows no permanent mold and no melt line.

With the casting apparatus 1 according to the second embodiment, exactly as with the first embodiment, it is possible to carry out a low-pressure casting process with a low-pressure permanent mold and a gravity casting process with a gravity permanent mold.

In the case of gravity casting, the gravity permanent mold is preferably always mounted outside the area of the base plate or the area above the furnace 11, so that the gravity permanent mold, after filling with melt, need not be moved linearly, but only requires to be swiveled. A linear movement would on the one hand delay the start of the swiveling operation, which may lead to melt already being partly cured and may, on account of the melt moving in the permanent mold, lead to impurities in the melt, which are not desired. In the gravity casting process, the permanent mold is preferably swiveled from the horizontal position around a predetermined angle of swivel, which may lie in the region of around 0° to 360° and preferably between 45° and 360°, and then swiveled back into the starting position. Filling of the gravity permanent mold is again effected by robots.

Alternatively, though, a bale-out line may be provided for filling the gravity permanent mold. Like the melt line 12 shown in the first embodiment, this leads upwards from the area below the base plate 2 into the area above the gravity permanent mold, terminating above the pouring basin of the gravity permanent mold. To keep this difference in height as small as possible it is expedient to provide the lifting device described above for the furnace 11, so that the latter may be lifted to a position directly below the base plate 2. If such a bale-out line is provided, then no robot is needed for filling the gravity permanent mold. The robot may then be omitted or used for handling the permanent mold.

LIST OF REFERENCE NUMBERS

1 casting apparatus
2 base plate
3 top frame
4 clamping plate
5 column
6 lifting mechanism
7 lifting rod
8 rail
9 holding frame
10 coupling element
11 furnace
12 melt line
13 low-pressure permanent mold
14 bottom mold half
15 top mold half
16 gravity permanent mold
17 robot
18 hinge
19 ladle
20 bottom mold half
21 top mold half
22 clamp
23 tilting table
24 tilting plate
25 holding arm
26 swivel joint
27 swivel motor
28 guide mechanism
29 guide rod
30 guide frame
31 sliding sleeve
32 bottom plate
33 bottom column
34 rollers

The invention claimed is:

1. Apparatus for the casting of cast parts comprising:

a pivotable retaining element capable of alternatively holding a low-pressure permanent mold or a gravity permanent mold, wherein the pivotable retaining element is compatible with both the low-pressure permanent mold and the gravity permanent mold but only holds one at a time, a furnace which is embodied to be connected to the low-pressure permanent mold in such a way that melt may be fed from below to the low-pressure permanent mold, held by the retaining element, in accordance with a low-pressure process, and a melt feed device which is embodied for feeding to the gravity permanent mold held by the retaining element from the furnace, when configured for a gravity casting process, wherein the gravity permanent mold has in its upper area a pouring basin which is open at a top, to which the melt is fed from above according to a gravity molding process, the apparatus configured to perform a method for casting of the cast parts comprising:

during the low-pressure process, mounting the low-pressure permanent mold in the pivotable retaining element and feeding melt from the furnace to the low-pressure permanent mold, via a melt line of the apparatus according to a low-pressure casting configuration, converting to a gravity casting configuration by mounting the gravity permanent mold in the pivotable retaining element to replace the low-pressure permanent mold, and during the gravity casting, feeding melt from the furnace to the gravity permanent mold using a melt feed device of the apparatus according to a gravity casting configuration, wherein the pivotable retaining element is compatible with both the low-pressure permanent mold and the gravity permanent mold.

2. Apparatus according to claim 1,
wherein
the retaining element is horizontally movable.

3. Apparatus according to claim 1,
further comprising a control unit designed for swiveling the retaining element, so that melt may be distributed in the gravity permanent mold.

4. Apparatus according to claim 1,
wherein
the retaining element is in the form of a holding frame.

5. Apparatus according to claim 1, wherein the retaining element is so designed that it may be swiveled from a horizontal position into an inclined position around an angle of at least 45°.

6. Apparatus according to claim 1, wherein holding fixtures are provided for fixing at least one gravity permanent mold to the retaining element.

7. Apparatus according to claim 1, further comprising a pivotably mounted tilting plate enabling the retaining element to pivot.

8. Apparatus according to claim 1, wherein the furnace is in the form of a combined low-pressure bale-out furnace.

9. Apparatus according to claim 1, wherein the apparatus includes a column press.

10. Apparatus according to claim 1, wherein there is provided a melt line for filling a low-pressure permanent mold or a bale-out line for filling a gravity permanent mold with melt from the furnace.

11. Apparatus according to claim 1, wherein a lifting device is provided for lifting the furnace.

12. Apparatus according to claim 1, wherein a bale-out device is provided to bale out melt from the furnace in order to fill a gravity permanent mold with melt, wherein the bale-out device includes a robot.

13. Apparatus according to claim 1, comprising the low-pressure permanent mold and the gravity permanent mold, which are interchangeably mounted in the pivotable retaining element.

14. Method for casting of cast parts with a casting apparatus according to low-pressure casting with a low-pressure permanent mold and a gravity casting with a gravity permanent mold, the method comprising:

during the low-pressure casting, mounting a low-pressure permanent mold in a pivotable retaining element of the casting apparatus and feeding melt from a furnace to the low pressure permanent mold, via a melt line of the casting apparatus according to a low-pressure casting configuration, converting to a gravity casting configuration by mounting, the gravity permanent mold in the retaining element to replace the low-pressure permanent mold, and during the gravity casting, feeding melt from the furnace to the gravity permanent mold using a melt feed device of the casting apparatus according to a gravity casting configuration, wherein the pivotable retaining element is compatible with both the low-pressure permanent mold and a gravity permanent mold.

15. The method according to claim 14, wherein the retaining element is horizontally movable.

16. The method according to claim 14, wherein the casting apparatus comprises a control unit designed for swiveling the retaining element, so that melt may be distributed in the gravity permanent mold.

17. The method according to claim 14, wherein the retaining element is in the form of a holding frame.

18. The method according to claim 14, wherein the casting apparatus comprises a pivotably mounted tilting plate enabling the retaining element to pivot.

* * * * *